US010143605B2

(12) United States Patent
Pitt

(10) Patent No.: US 10,143,605 B2
(45) Date of Patent: Dec. 4, 2018

(54) SUPPORT PLATFORM FOR SEATING APPLIANCE

(71) Applicant: Roma Medical Aids Limited, Bridgend (GB)

(72) Inventor: John Pitt, Bridgend (GB)

(73) Assignee: Roma Medical Aids Limited, Bridgend (GB)

( * ) Notice: Subject to any disclaimer, the term of this patent is extended or adjusted under 35 U.S.C. 154(b) by 2 days.

(21) Appl. No.: 14/787,258

(22) PCT Filed: Apr. 25, 2014

(86) PCT No.: PCT/GB2014/051309
§ 371 (c)(1),
(2) Date: Oct. 26, 2015

(87) PCT Pub. No.: WO2014/174321
PCT Pub. Date: Oct. 30, 2014

(65) Prior Publication Data

US 2016/0067124 A1 Mar. 10, 2016

(30) Foreign Application Priority Data

Apr. 26, 2013 (GB) ..... 1307600.5

(51) Int. Cl.
*A61G 5/10* (2006.01)
*A47C 7/02* (2006.01)
*A61G 7/057* (2006.01)

(52) U.S. Cl.
CPC ..... *A61G 5/1056* (2013.01); *A61G 5/1043* (2013.01); *A61G 5/1045* (2016.11);
(Continued)

(58) Field of Classification Search
CPC ..... A61G 5/1056; A61G 5/1081; A47C 7/14; A47C 7/16; A47C 7/3453; A47C 7/345;
(Continued)

(56) References Cited

U.S. PATENT DOCUMENTS 1,716,176 A * 6/1929 Vitez-Keresztfalvy ..... A47C 31/04 5/191
1,906,233 A * 5/1933 Leigh ..... A47C 7/282 267/112

(Continued)

FOREIGN PATENT DOCUMENTS

GB 1 163 263 A 9/1969

OTHER PUBLICATIONS

International Search Report; PCT/GB2014/051309; dated Aug. 18, 2014.

*Primary Examiner* — Timothy J Brindley
(74) *Attorney, Agent, or Firm* — Gordon & Jacobson, P.C.

(57) ABSTRACT

A support arrangement and corresponding method, is provided for supporting a user in a seated invalid appliance, the arrangement comprising a support member and at least one reconfigurable connection arrangement arranged to enable connection of the support member to the appliance and the application an adjustable tensile load to the support member. The connection arrangement may comprise a bridging element configured to extend between the support member and the appliance, such as a clip or hook. The hook or clip may be S-shaped or C-shaped in cross section. The connection arrangement may be received in an aperture or recess provided in the support member and/or the appliance to bridge the gap there between. The invention is particularly suited for use with wheelchairs or seated sports appliances for a disabled user.

14 Claims, 7 Drawing Sheets

(52) U.S. Cl.
CPC ..... *A61G 5/1081* (2016.11); *A61G 5/1091* (2016.11); *A61G 7/057* (2013.01)

(58) Field of Classification Search
CPC .... A47C 7/02; A47C 7/28; A47C 7/35; A47C 7/282
See application file for complete search history.

(56) References Cited

U.S. PATENT DOCUMENTS 3,000,019 A * 9/1961 Maurer ..... A47C 7/282 297/452.55
3,208,085 A * 9/1965 Grimshaw ..... A47C 7/18 297/452.55
3,289,220 A 12/1966 Grimshaw
3,502,316 A * 3/1970 Saether ..... A47C 7/282 160/378
3,913,978 A * 10/1975 Lester ..... A47C 31/04 297/448.2
3,992,023 A * 11/1976 Moorer ..... A61G 5/00 280/87.021
4,435,014 A * 3/1984 Gilardi ..... A47C 7/22 297/452.48
4,493,488 A * 1/1985 Panaia ..... A61G 5/08 248/157
4,629,246 A 12/1986 Fulton
4,869,554 A * 9/1989 Abu-Isa ..... B60N 2/7011 297/448.2
4,997,154 A * 3/1991 Little ..... A61G 5/08 248/230.5
5,074,620 A * 12/1991 Jay ..... A61G 5/1043 297/252
5,189,747 A * 3/1993 Mundy ..... A61G 5/1043 24/30.5 S
5,568,933 A * 10/1996 Mizuno ..... A61G 5/08 280/250.1
5,848,824 A * 12/1998 Mocur ..... A61G 5/10 297/338
5,857,750 A * 1/1999 Kashiwamura ..... A47C 7/14 248/608
5,984,418 A 11/1999 McInturff
6,158,815 A * 12/2000 Sugie ..... A47C 7/282 297/452.49
6,454,485 B2 * 9/2002 Holcomb ..... A61G 5/10 403/325
2008/0036266 A1 * 2/2008 Battey ..... A47C 4/02 297/440.21

* cited by examiner

SUPPORT PLATFORM FOR SEATING APPLIANCE

This invention relates generally to seated appliances for mobility-impaired users, such as disabled persons, the elderly, the infirm, patients etc.. More particularly it relates to seat or cushion platforms for use in such seated appliances. The invention is particularly suited, but not limited to, use in wheelchairs.

When a person remains in a sitting position for a long period of time, problems such as pressure sores can develop. Persons who have reduced mobility (e.g. disabled persons, those suffering or recovering from illness, the elderly etc.) often use seated appliances such as wheelchairs and other types of chairs for prolonged periods, and so pressure sores and general comfort can be a significant concern for such users.

When seated, the largest proportion of one's body weight is carried through the pelvic area onto the seat of the appliance's support system. Moreover, someone with a disability is often unable to sit with an upright posture. They may lack the ability to sit up straight and so may lean to one side, putting increased pressure on certain points of their body such as the buttocks and/or upper legs. Therefore, the support platform is of great importance when designing a seated appliance for a mobility-impaired user.

Many wheelchairs etc. are provided with a canvas 'sling'. However, such canvas seats sag over time, thus causing the user to sit in an asymmetric position, or with their thighs and knees being directed inwardly towards each other. This may lead to the development of uncomfortable pressure points. Additionally, 'shearing' may occur; the outer layer of skin is pulled in a certain direction while distorting and restricting the underlying blood vessels. This may lead to pressure sores.

In order to overcome these problems associated with sitting directly on the canvas sling, it is common practice for a cushion to be placed on top of the sling to increase comfort. As the sling will not provide the necessary stability to support the cushion, a 'rigidiser' may be placed on top of the sling so as to provide a firm base. This rigidiser may comprise a substantially inflexible sheet or plate (such as ply wood) which is placed inside a cushion cover, underneath the cushion. Alternatively, the rigidiser may simply be positioned to rest upon the horizontal frame elements of the wheelchair body between the canvas sling and the cushion. Further still, a 'drop seat' may be used. When using a drop seat, the original wheelchair seat canvas is removed and a rigid seat board, mounted on four 'drop hooks' is mounted directly onto the wheelchair frame. The user's choice of cushion may then be mounted onto the drop seat.

However, none of these prior art arrangements provide the ability to adjust the tensioning of the support platform to customise or tailor the support according to the individual user.

In one prior art solution, it has been known for adjustable straps to be used in place of the canvas sling. The straps pass through loops provided along the side walls or body of the wheelchair, and are folded over back onto themselves before being fastened (typically with velcro). While this allows the tensile load of the support base to be adjusted, the textile straps still have a tendency to sag over time, or they work loose and therefore need to be readjusted after a period of time.

Thus, it is desirable to provide a support arrangement which can be used to support a seated, mobility-impaired user in a seated appliance, the support arrangement being configurable such that the tensile load applied to the support can be adjusted according to the individual needs of the user. Such a solution should provide a base which does not sag, and does not require readjustment over time due to working loose of the components.

Such an improved solution has now been devised.

Thus, in accordance with the present invention there is provided a support arrangement and corresponding method as defined in the appended claims.

Therefore, in accordance with the invention there may be provided a support arrangement for supporting a user in a seated invalid appliance, comprising:

a support member; and at least one reconfigurable connection arrangement arranged to enable:

connection of the support member to the appliance; and the application an adjustable tensile load to the support member.

The invalid appliance may be a mobility appliance such as a wheelchair. It may be any type of wheelchair, such as a wheelchair designed for participating in a sporting activity. It may be any type of seated sports appliance for a disabled user, such as a disabled bicycle.

It should be noted however, that the invention is not limited to use with wheelchairs The invention may be applied without inventive adaptation to any seated appliance in which a mobility-impaired user is to be seated. The term 'invalid appliance' may include invalid chairs such as hospital/nursing home chairs The support member may be referred to as a 'support plate'. The term 'plate' should not be construed as being limited to a flat or sheet like element, but should be constructed as simply meaning a base which serves as a support upon which the user and/or a cushion can rest during use.

The support member may be configured to fit within the seating area of the appliance. The appliance may have a body which comprises opposing sides. The appliance may comprise tubular frame elements.

The at least one connection arrangement may comprise a bridging element configured to extend between the support member and the appliance. Thus, the support member may be dimensioned such that it is smaller than the profile of the seating area of the appliance, leaving a gap or space between the edge of the support member and the appliance.

The connection arrangement may comprise a first portion configured for (direct or indirect) connection to the support member and a second portion configured for (direct or indirect) connection to the appliance.

The first portion and/or second portion may be provided on the bridging element, possibly at opposing ends of the bridging element.

The connection arrangement may comprise a clip or hook. The clip or hook may comprise titanium. The clip or hook may serve as the bridging element. The bridging element may be a hook or clip which attaches at one end (the first portion) to the support member and at the other end (second portion) to the appliance. In this way, the bridging element may stretch or extend between the appliance and the support member.

The connection arrangement may be substantially S shaped or C shaped in cross section.

The connection arrangement may comprise a hook or angled flange at one or both ends.

In a preferred embodiment, the support arrangement comprises a plurality of reconfigurable connection arrangements each configured to apply an adjustable tensile load to the support member. Thus, the support arrangement may enable the application of an adjustable tensile load at a plurality of individual, localised points the appliance. Preferably, there may be a plurality of adjustable connection arrangements provided on opposing sides of the support member. This provides a stable base, and allows the tensile load applied to the plate to be finely adjusted according to the individual needs of the user.

Preferably, the support member is substantially rigid. The support member may be substantially flat or may be contoured (e.g. to fit the user's body) or may be textured. It may comprise a substantially plastic or metal sheet. It may be generally square or rectangular.

The support plate may comprise at least one aperture. This provides the advantage that the weight of the support member can be minimised. It also serves to provide ventilation when the user is seated.

Preferably, the connection arrangement facilitates suspension of the support member from the appliance. The support member may be suspended from opposing side walls or arms of the appliance.

At least one portion of the connection arrangement may be arranged to pass through, hook around or be received within a portion of the support member. Thus, the connection arrangement may be configured to secure to the support member in any manner. It may be integrally formed with the support member. It may be permanently fixed to the support member (e.g. by welding) or constructed as part of the support member. Alternatively, it may be removably attached to the support member e.g. by hooking through or round a portion of the support member.

Preferably, the connection arrangement comprises a load adjustment arrangement configured to permit adjustment of the tensile load applied to the support member.

The load adjustment arrangement may comprise a shaft. The shaft may be a threaded shaft. It may be the shaft of a screw. The screw may have a head at one end.

The shaft may be arranged to pass through a portion of the appliance. Thus, it may pass through a bore, channel or aperture provided in or on a portion of the appliance. It may pass through a side portion or wall of the appliance.

The connection arrangement may comprise a bridging element configured to extend between the support member and the appliance, one end of the bridging element being configured for attachment to the support member. The shaft may be arranged to pass through a portion of the bridging element. It may pass through a hook or angled portion of the bridging element.

A nut or stop may be provided on the shaft. The nut or stop may be threaded so as to cooperate with the shaft.

Also in accordance with the invention there is provided a seated invalid appliance, such as a wheelchair or sporting appliance for a disabled person, or an invalid chair, the appliance comprising a support arrangement substantially as described above.

Also in accordance with the present invention there is provided a method corresponding to the apparatus as described above. Thus, there is provided a method of applying an adjustable tensile load to a user support arrangement of a seated invalid appliance, the method comprising the step:

using a plurality of reconfigurable connection arrangements to connect a support member to the appliance, each connection arrangement being configured to apply an adjustable tensile load to the support member.

The appliance may be a wheelchair or seated sports appliance (e.g. bicycle) for a disabled user. It may be an invalid chair.

The connection arrangements may be formed and/or configured as described above in respect of the support arrangement.

These and other aspects of the present invention will be apparent from and elucidated with reference to, the embodiment described herein.

An embodiment of the present invention will now be described, by way of example only, and with reference to the accompany drawings, in which.

Figure 1:
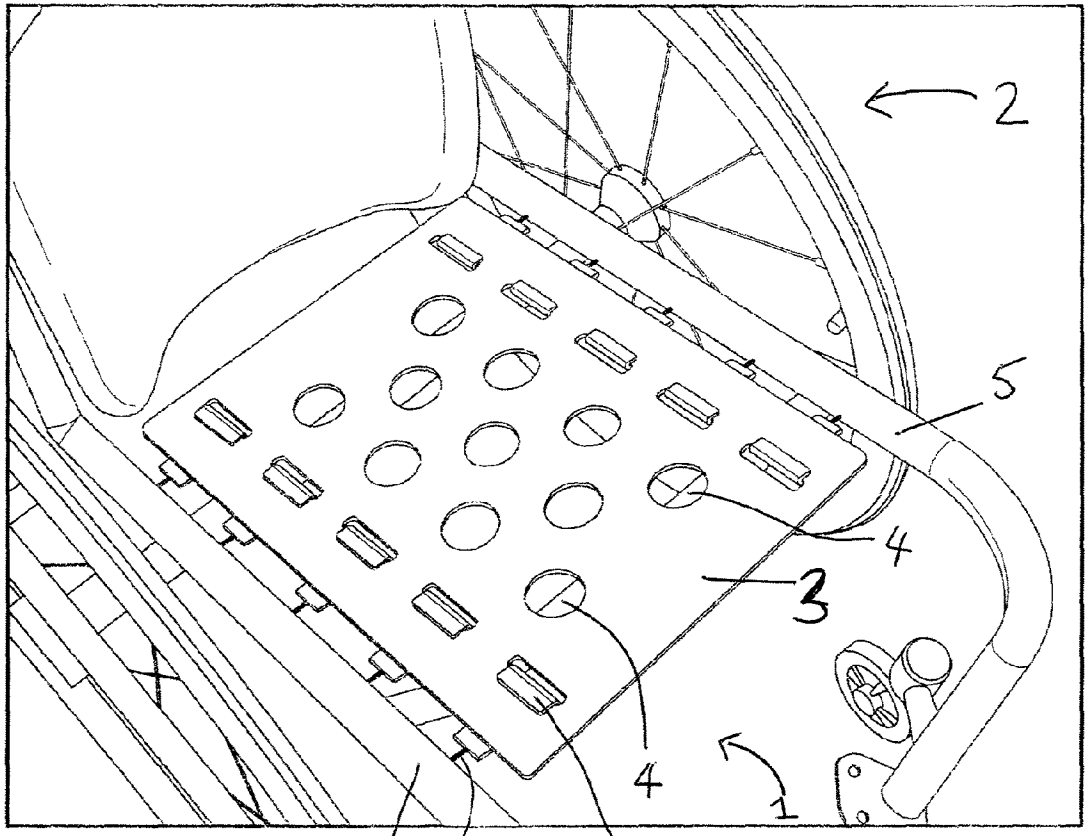
FIG. 1 shows a support arrangement in accordance with an illustrative embodiment of the present invention and installed on a wheelchair, ready to support a cushion and/or user (not shown).
Figure 2:
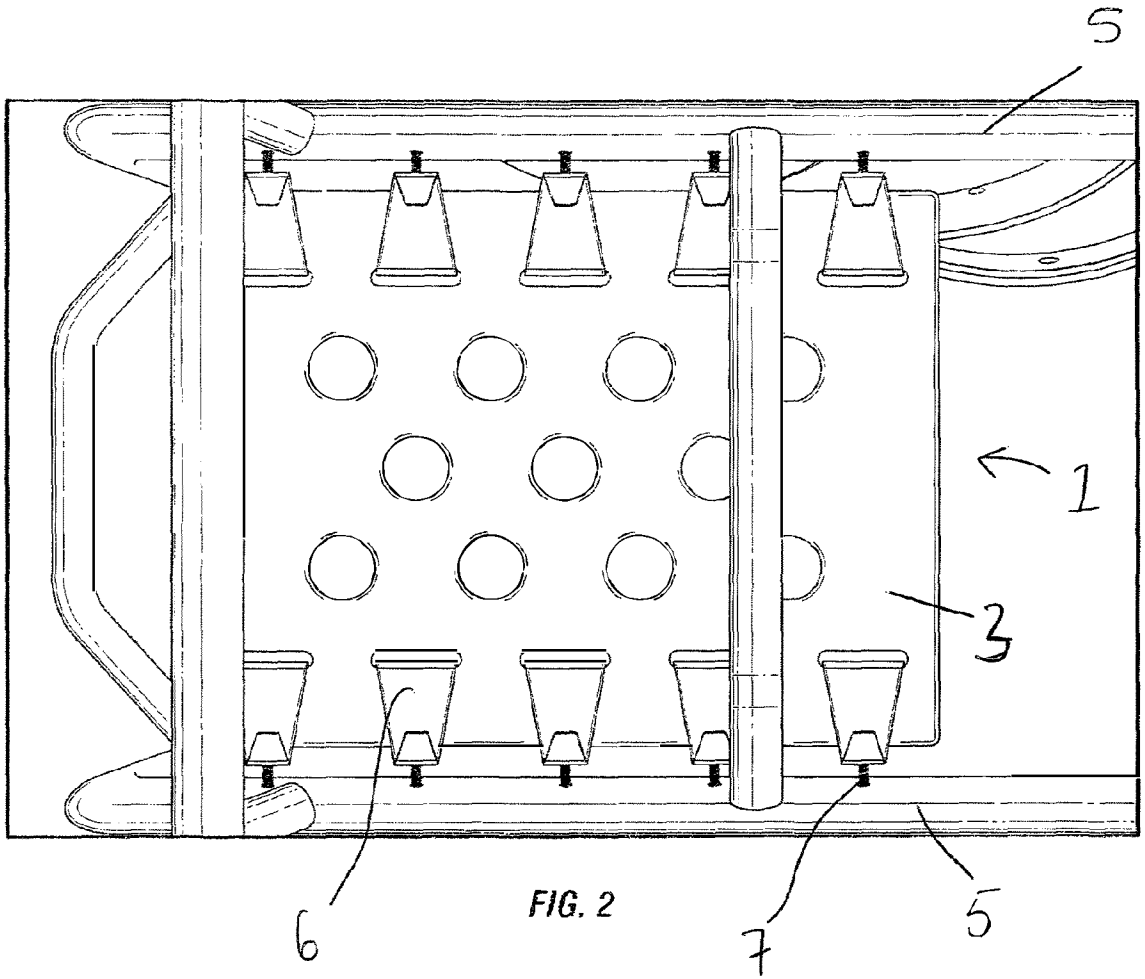
FIG. 2 shows the arrangement of FIG. 1 from below i.e. the underside of the support member ('support plate') is shown.
Figure 3:
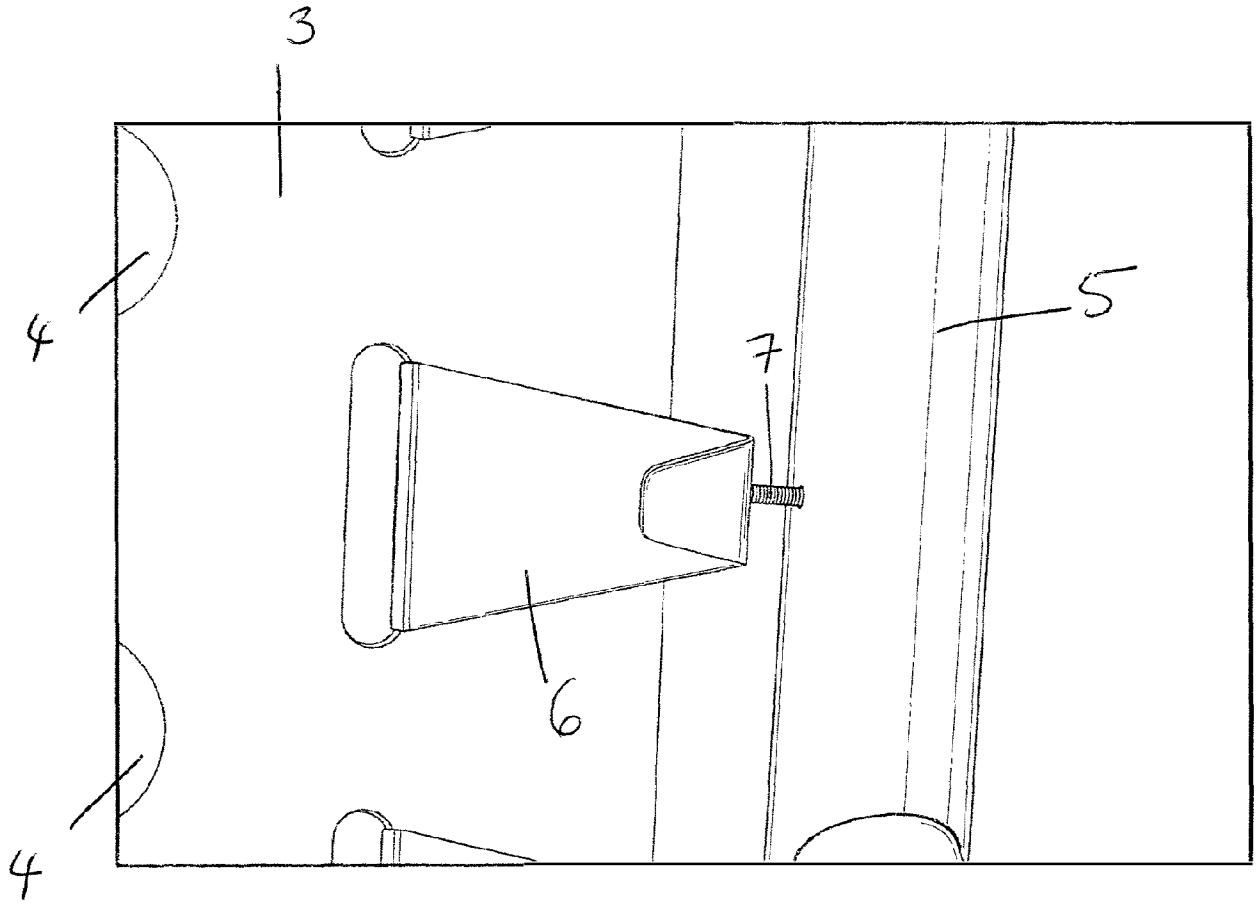
FIG. 3 shows a connection arrangement and support plate in accordance with an illustrative embodiment of the invention and installed for use with an appliance.
Figure 4:
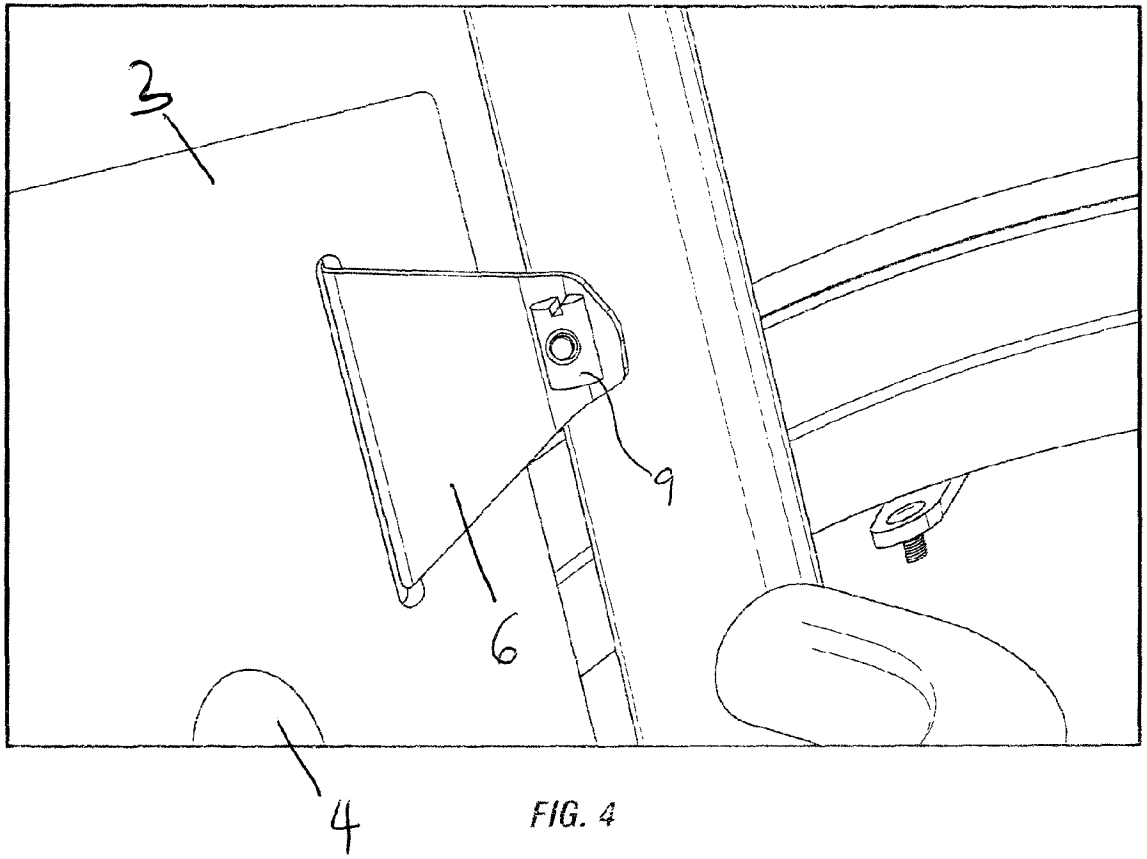
FIG. 4 shows the underside of the connection arrangement and plate of FIG. 3.
Figure 5:
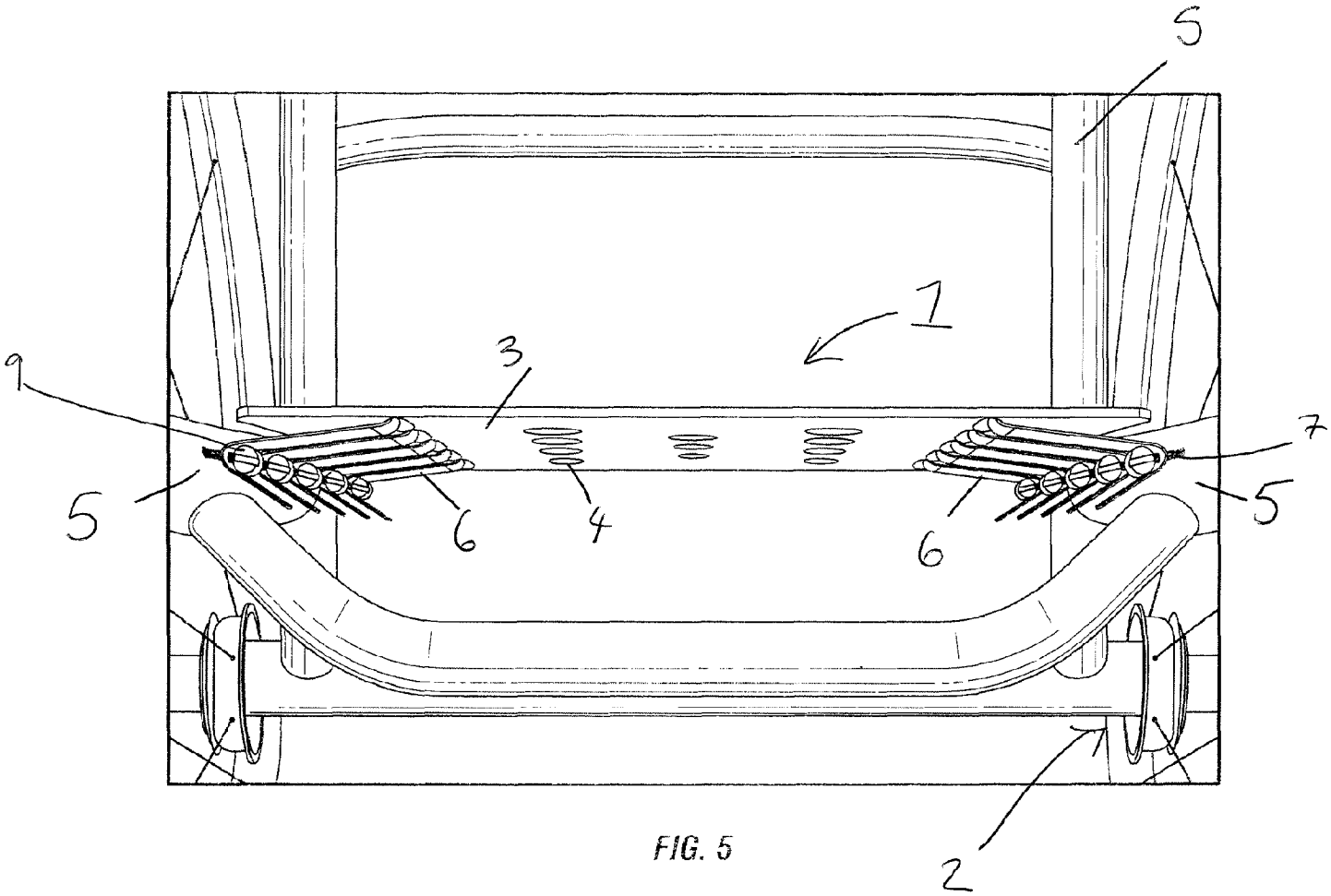
Figure 6:
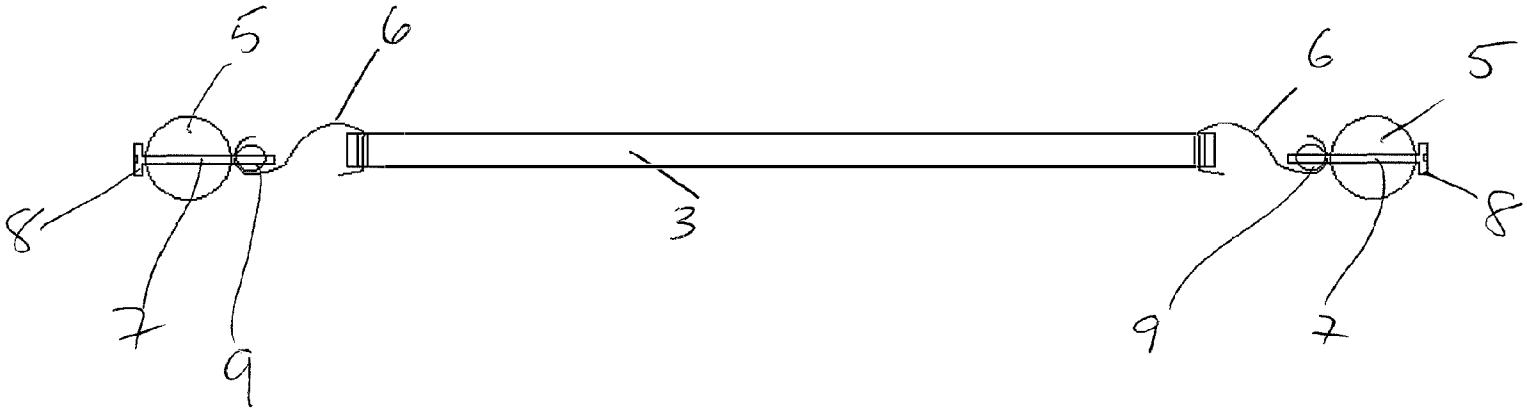

FIG. 5 shows a different perspective of the embodiment of FIG. 1. FIG. 5 shows the arrangement from the front and illustrates a plurality of connection arrangements being used to suspend a support plate from the side bars of a wheelchair FIG. 6 shows a schematic view of the embodiment of FIGS. 1 to 5. The connection arrangement is shown as an S-shaped, double ended hook or clip.

Figure 7:
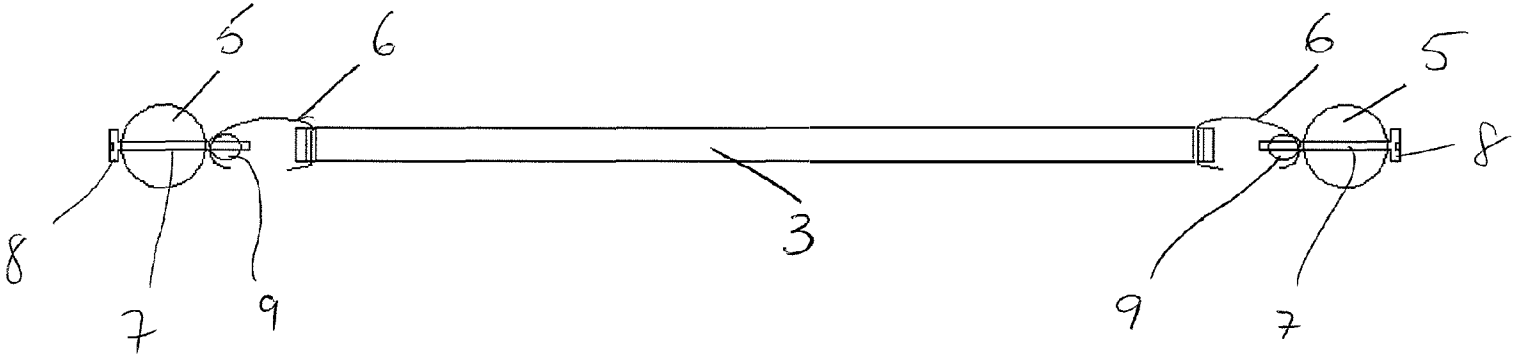

FIG. 7 shows an alternative embodiment of FIG. 6, wherein the connection arrangement is shown as substantially C-shaped rather than S-shaped.

The figures illustrate a support arrangement 1 installed on a wheelchair 2. It should be noted however, that the invention is not limited to use with wheelchairs. For the sake of convenience only, the seated invalid appliance will be referred to hereinafter as a wheelchair.

In use, the support arrangement 1 provides a platform or base which supports the user who is seated in the wheelchair 2. The invention provides a stable and adjustable base upon which a cushion or pad can be placed so as to provide comfort for the user and prevent problems such as pressure sores.

In accordance with a preferred embodiment of the invention, the figures show a support arrangement 1 comprising a substantially rigid support plate 3 and a connection arrangement for securing the plate 3 to the appliance 2 in an adjustable manner. The plate 3 may be made of plastic, although any material could be used which is sufficiently strong to support the weight of the user.

The plate 3 is provided with apertures 4 so as to minimise the weight of the support arrangement 1 (and thus the overall wheelchair 2) and to also provide ventilation or drainage during use.

In a typical embodiment, the plate 3 is generally square or rectangular in shape but any shape or contour can be used to enable the plate to fit within the contour of the wheelchair 2. The plate 3 fits within the seating area of the wheelchair such that there is a gap between the edge of the plate and the body 5 of the wheelchair.

The plate 3 is connected to the frame 5 of the appliance 2 by a plurality of connection arrangements provided on opposing sides of the plate 3. Each connection arrangement comprises a clip 6. In a preferred embodiment, the clips are made of titanium which provides the required strength whilst being lightweight. The clips extend between the edge of the plate 2 and the body 5 of the wheelchair, bridging at least some of the gap there between.

In one embodiment, the clip 6 is S shaped as shown in FIG. 6. Each clip 6 is configured at one end (referred to as a 'first end') for connection to the plate 2. The first end of the clip 6 is angled or bent back on itself so as to provide a flange or hook which can pass through an aperture formed in the plate. After passing through the aperture, the flange lies parallel to the surface of the plate. This is clearly shown in FIG. 1. Thus, in use, the plate is sandwiched and retained between two sections of the clip. This provides a secure connection which cannot be easily broken during use, thus reducing the risk of injury or discomfort to the seated user.

The other (second) end of the clip 6 is also angled or bent over to provide a hook or flange. Thus, each clip is generally S-shaped in cross section as per FIG. 6. However, FIG. 7 shows an alternative version wherein the clip is substantially C-shaped.

In certain embodiments, the second end of the S-shaped clip 6 could be hooked directly through or into the body 5 of the wheelchair so as to connect it to the plate 2. However, in a preferred embodiment, the flange of the second end is provided with an aperture. A screw having a head 8 and a threaded shaft 7 extends through a bore provided in the frame 5 of the appliance, and then through the aperture in the second clip end. A stop or nut 9 is threaded onto the end of the threaded shaft 7 such that the clip is retained between the nut and the frame of the appliance.

The head 8 of the screw is dimensioned such that it cannot pass through the bore in the frame 5 of the appliance. However, the head 8 may be recessed into the frame 5 during use.

Thus, in use, a technician is able to rotate each individual screw in a clockwise or anti-clockwise direction, so as to increase or decrease the tensile load applied to the plate by each screw. By rotation of the screw in one direction the edge of the plate can be pulled by the clip towards the body 5 of the wheelchair thus increasing the tensile load on the plate at that localised point. Rotation in the opposite direction relieves or reduces the tension. The degree of rotation determines the amount of increase/decrease in the load.

In this way, the plate can be tensioned according to the individual needs of the user.

The arrangement described above provides the following advantages:

- it provides a secure support for the user; the manner in which the clips connect the plate to the appliance results in a secure connection which is unlikely to come apart or work loose; this minimises the risk injury or discomfort to the user;
- the tensioning means (screws) can be easily and quickly adjusted by rotation of the screw(s);
- the more screws and clips provided, the greater flexibility the technician has when adjusting the tension in accordance with the individual needs of the user.

It should be noted that the above-mentioned embodiments illustrate rather than limit the invention, and that those skilled in the art will be capable of designing many alternative embodiments without departing from the scope of the invention as defined by the appended claims. In the claims, any reference signs placed in parentheses shall not be construed as limiting the claims. The word "comprising" and "comprises", and the like, does not exclude the presence of elements or steps other than those listed in any claim or the specification as a whole. In the present specification, "comprises" means "includes or consists of" and "comprising" means "including or consisting of". The singular reference of an element does not exclude the plural reference of such elements and vice-versa. In a device claim enumerating several means, several of these means may be embodied by one and the same item of hardware. The mere fact that certain measures are recited in mutually different dependent claims does not indicate that a combination of these measures cannot be used to advantage.

The invention claimed is:

1. A support arrangement for supporting a user in a seated invalid appliance, comprising:

a support member; and a plurality of reconfigurable connection arrangements, wherein each one of the plurality of reconfigurable connection arrangements is coupled to the support member of the appliance and is configured to apply an adjustable tensile load to the support member, wherein each of the reconfigurable connection arrangements comprises a rotatable threaded section having opposed first and second ends, wherein the first end is coupled to the appliance and the second end is coupled to the support member, wherein rotation of the threaded section in a first direction increases the tensile load applied to the support member by the respective connection arrangement, and wherein rotation of the threaded section in a second direction opposite the first direction decreases the tensile load applied to the support member by the respective connection arrangement, wherein each connection arrangement is configured to permit adjustment of the tensile load applied to the support member, wherein each connection arrangement comprises a shaft arranged to pass through a portion of the appliance, and comprises a bridging element configured to extend between the support member and the appliance, one end of the bridging element being configured for attachment to the support member, and wherein the shaft is arranged to pass through a portion of the bridging element.

2. A support arrangement according to claim 1 wherein the appliance is a wheelchair or seated sports appliance for a disabled user.

3. A support arrangement according to claim 1 wherein the at least one connection arrangement comprises a bridging element configured to extend between the support member and the appliance.

4. A support arrangement according to claim 1 wherein the connection arrangement comprises a first portion configured for connection to the support member and a second portion configured for connection to the appliance.

5. A support arrangement according to claim 1 wherein the connection arrangement comprises a titanium clip or hook.

6. A support arrangement according to claim 1 wherein the connection arrangement is substantially S shaped or C shaped in cross section.

7. A support arrangement according to claim 1 wherein the connection arrangement comprises a hook or angled flange at one or both ends.

8. A support arrangement according to claim 1 wherein the support member is substantially rigid.

9. A support arrangement according to claim 1 wherein the support member comprises at least one aperture.

10. A support arrangement according to claim 1 wherein the plurality of reconfigurable connection arrangements facilitate suspension of the support member from the appliance.

11. A support arrangement according to claim 1 wherein at least one portion of each connection arrangement is arranged to pass through, hook around or be received within a portion of the support member.

12. A support arrangement according to claim 1, wherein a nut or stop is provided on the shaft.

13. A method of applying an adjustable tensile load to a user support arrangement of a seated invalid appliance, the method comprising:

using a plurality of reconfigurable connection arrangements to connect a support member to the appliance, each one of the plurality of reconfigurable connection arrangements being configured to apply an adjustable tensile load to the support member, wherein each of the reconfigurable connection arrangements comprises a rotatable threaded section having opposed first and second ends, wherein the first end is coupled to the appliance and the second end is coupled to the support member, wherein rotation of the threaded section in a first direction increases the tensile load applied to the support member by the respective connection arrangement, and wherein rotation of the threaded section in a second direction opposite the first direction decreases the tensile load applied to the support member by the respective connection arrangement wherein each connection arrangement is configured to permit adjustment of the tensile load applied to the support member, wherein each connection arrangement comprises a shaft arranged to pass through a portion of the appliance, and comprises a bridging element configured to extend between the support member and the appliance, one end of the bridging element being configured for attachment to the support member, and wherein the shaft is arranged to pass through a portion of the bridging element; and rotating the threaded section of at least one of the plurality of reconfigurable connection arrangements in at least one of the first direction and the second direction to apply a user-selected tensile load to the support member.

14. A method according to claim 13 wherein the appliance is any of:

a wheelchair;

seated sports appliance for a disabled user; and an invalid chair.

* * * * *